US006065647A

United States Patent [19]

Bliss, III et al.

[11] Patent Number: 6,065,647

[45] **Date of Patent: *May 23, 2000**

[54] PUMP DISPENSER HAVING A LOCKING SYSTEM WITH DETENTS

[75] Inventors: Earnest E. Bliss, III, Perrysburg, Ohio; Alan W. Kieler, Sarasota, Fla.

[73] Assignee: Owens-Illinois Closure Inc., Toledo, Ohio

[ * ] Notice: This patent is subject to a terminal disclaimer.

[21] Appl. No.: 09/292,927

[22] Filed: Apr. 16, 1999

Related U.S. Application Data

[63] Continuation of application No. 08/995,977, Dec. 22, 1997, Pat. No. 5,899,363.

[51] Int. Cl.[7] ..... B67D 5/32

[52] U.S. Cl. ..... 222/153.02; 222/153.13; 222/321.9; 222/384

[58] Field of Search ..... 222/153.02, 153.13, 222/153.14, 321.7, 321.9, 341, 380, 384, 385

[56] References Cited

U.S. PATENT DOCUMENTS

| | | | |
|---|---|---|---|
| 3,627,206 | 12/1971 | Boris | 239/321 |
| 4,162,746 | 7/1979 | Anderson et al. | 222/153 |
| 4,589,573 | 5/1986 | Tada | 222/153 |
| 4,958,752 | 9/1990 | Maerte et al. | 222/321 |
| 5,284,276 | 2/1994 | Cater | 222/321 |
| 5,335,830 | 8/1994 | Cater | 222/153 |
| 5,423,459 | 6/1995 | Cater | 222/321.8 |
| 5,615,806 | 4/1997 | Grathoff | 222/153.13 |
| 5,772,080 | 6/1998 | de Pous et al. | 222/321.7 |
| 5,839,617 | 11/1998 | Cater et al. | 222/321.9 |
| 5,899,363 | 5/1999 | Bliss, III et al. | 222/384 |

*Primary Examiner*—Joseph A. Kaufman

[57] ABSTRACT

Lotion pump has a stepped piston telescoping inside a stepped body to define a pumping chamber. The piston has a downward annular wall having inlet and discharge apertures, one above the other, to the pumping chamber. A stem integral with the actuator has a sealing head inside the annular wall which shuttles up and down between positions at which it covers one aperture or the other. Shuttling is implemented by lost-motion between the actuator spout/stem and piston. A spring urges the stem up at all times. The actuator can be turned to lock the head over the discharge aperture by nullifying the lost-motion. Further turning can lock the stem in lockdown position. One-directional turn-back can liberate the head and unlock the lockdown. Detents control sequence of unlocking.

3 Claims, 3 Drawing Sheets

PUMP DISPENSER HAVING A LOCKING SYSTEM WITH DETENTS

CROSS REFERENCE TO RELATED APPLICATIONS

This application is a continuation of application Ser. No. 08/995,977 filed Dec. 22, 1997, now U.S. Pat. No. 5,899, 363.

FIELD OF THE INVENTION

This invention relates to a pump dispenser comprising an axial shuttle valve operated by an actuator and taking the place of the usual inlet and outlet check valves.

BACKGROUND OF THE INVENTION

The Cater U.S. Pat. No. 5,284,276 issued Feb. 8, 1994, discloses a meritorious pump for lotions or the like including a tubular main piston having an outward flange and seal. A stepped cylindrical pump body telescopingly receives the piston to define a pumping chamber. The piston has a unitary tubular upward axial outlet provided with a valve seat at its lower end. Adjacent and below the valve seat the wall of the piston is apertured. An actuator spout/stem, assembled as a single fixed-together, rigid unit, extends down centrally through the tubular upward outlet and seat. The lower end of the stem is formed with a valve head inside the piston in sealing engagement with the piston wall and adapted to rise to seat on the valve seat.

There is a lost-motion space between the actuator/stem and the piston so that, upon depression of the actuator, the stem drops with respect to the piston and the valve head unseats and moves below the aperture in the piston wall before the piston starts to move down. Continuing the same downward stroke, the actuator pressurizes liquid in the pump chamber and forces it out the aperture up through the valve seat and out the actuator spout.

A spring urges the actuator/stem up on the return stroke. The stem first raises up inside the piston, again opening the lost-motion space and forcing the head to seat on the valve seat and opening the aperture in the piston wall below the head. As the head engages a shoulder on the piston, the continued upward force of the spring then raises the piston. As the piston raises, it creates a vacuum in the pumping chamber, drawing lotion up through a dip tube at the lower end of the pump body, into the piston and through the aperture into the chamber ready for the next downstroke.

Under an improvement of the Cater pump disclosed in the pending patent application Ser. No. 08/902,027 filed Jul. 29, 1997, now U.S. Pat. No. 5,839,617, issued Nov. 24, 1998 and assigned to the assignee of this application, and incorporated hereinto by reference, the above-described valve seat is replaced by a second aperture in the piston wall above the aperture described. The stem head is in the form of a peripheral bi-directional fin-type seal which moves during the exercise of the lost-motion from a first position wherein the upper aperture is covered and the lower aperture uncovered to a second position wherein the lower aperture is covered and the upper aperture uncovered.

By having both apertures at the same diameter on the wall of the piston, manufacture is simplified and leaks are less likely. The head may have a peripheral seal of a single diameter. The improved arrangement better accommodates dimensional variations and does not require such precise molding. Also, finned-type seals are flexible and are more forgiving of dimensional variations. The clogging of the valve with a vertical beveled seating surface is not a concern.

In addition, the resulting structure permits separate apertures for the pump chamber inlet and discharge flow. Having separate apertures for the opposite flows, into and out of the pumping chamber, makes simpler flow paths and improves the efficiency of the pumping action in this relatively short-stroke application.

In a preferred version the two apertures may be in the form of a single elongated window, the upper portion of which, when exposed, constitutes the discharge and the lower portion, when exposed, constitutes the inlet of the pumping chamber. In the windowed version, the fin-type seals do not encounter the transverse edges of apertures which can cause wear. These two arrangements—the two separate apertures and the elongate window—are regarded as equivalent.

In another Cater U.S. Pat. No. 5,335,830 issued Aug. 9, 1994 incorporated hereinto by reference, a pump of this genre is provided with means for locking the stem with the head in a first position covering the discharge aperture. This comprises a step up in the lost-motion slot so that when the actuator is turned, the abutment surface on the actuator engages the step, nullifying the lost-motion, and the stem thereafter does not lower with respect to the piston, and the discharge is effectively "locked" closed. The '830 patent also provides an inward tooth on the retainer and an upward shoulder near the top of the piston. When the piston is pushed down and turned by the actuator, the shoulder is engaged by the tooth and the piston and actuator is locked down as is preferred for shipment.

It is an object of the present invention to provide means to give the consumer a tactile "feel" or snap when the locks are engaged.

Another object is to provide for a type of pump as shown in Cater U.S. Pat. No. 5,335,830 means assuring that the lockdown is not released until the means for disabling the discharge valve is nullified so that when the pump actuator rises from lockdown position the pump is fully operative.

SUMMARY OF THE INVENTION

The invention is defined in the claims appended hereto. In summary, the invention provides detents for both the discharge valve lock and the piston lockdown of the dispenser disclosed in the Cater '830 patent. The detent for the discharge valve lock is less stiff—that is, more easily overcome—than the detent for the piston lockdown. Thus, as the actuator is turned to unlock the two locks, the discharge valve lock detent is cleared first and then the piston lockdown detent is cleared. When the actuator pops up, the consumer is assured the pump dispenser is fully operative.

BRIEF DESCRIPTION OF THE DRAWINGS

Further objects and features of the invention will be clear to those skilled in the art from a review of the following specification and drawings, all of which present a nonlimiting form of the invention. In the drawings.

DESCRIPTION OF THE PREFERRED EMBODIMENT

Figure 1:
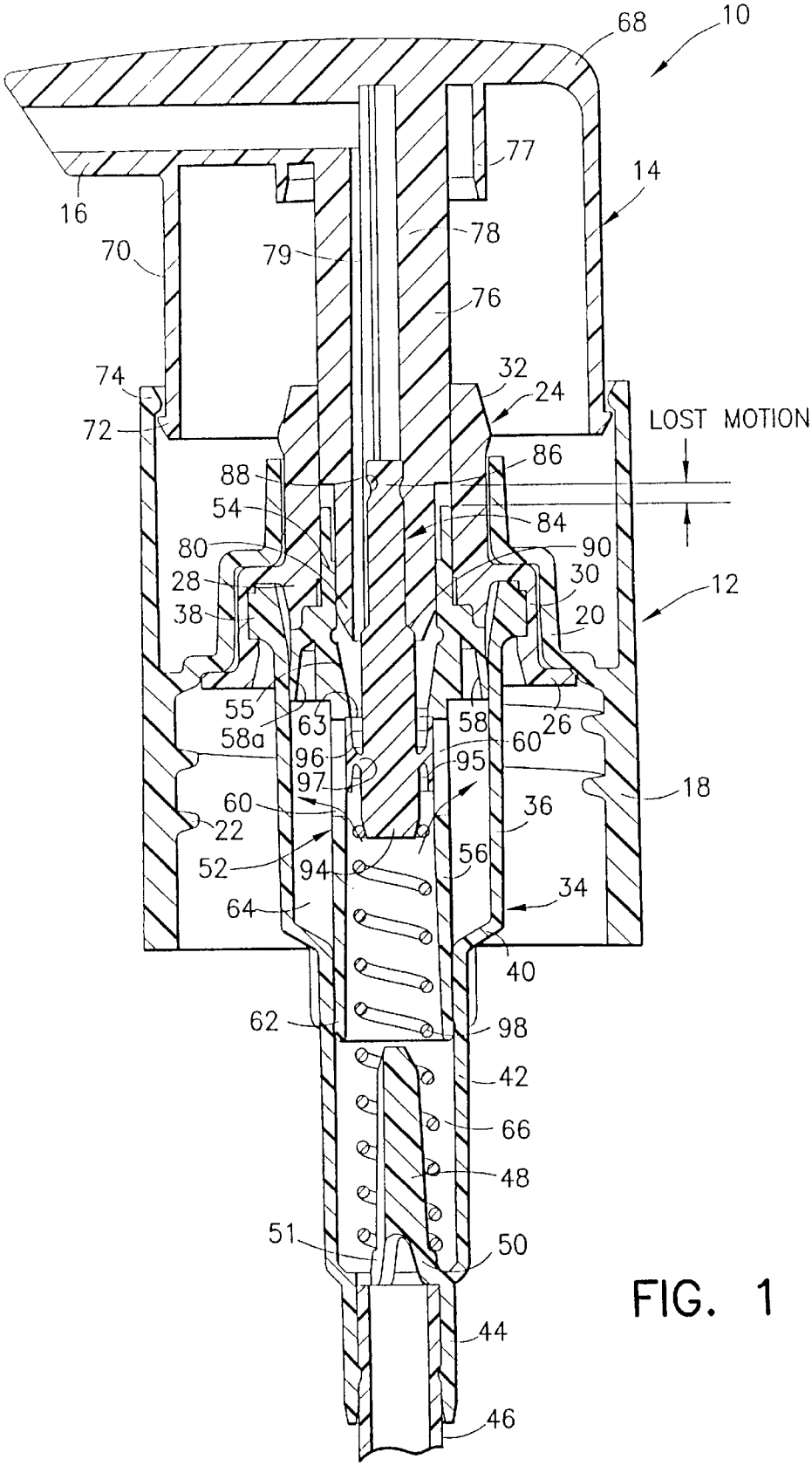
FIG. 1 is a sectional centerline view of a pump embodying the invention showing the actuator/stem assembly in the first position with arrows showing the flow in the upstroke mode of the actuator.

A dispensing pump embodying the invention is shown in FIG. 1 and generally designated 10. It comprises a closure 12 and an actuator 14 which telescopes down inside the top of the closure 12 when the actuator 14 is pressed down. The actuator includes the dispensing spout 16.

The closure 12 comprises a generally cylindrical shell 18 having inward therefrom intermediate its ends a stepped annular flange 20. Beneath the merging of the flange with the cylindrical shell 18 the shell is formed internally with threads 22 adapted to screw onto mating threads on the finish of a container (not shown).

An annular retainer 24 fits snugly against the underside of the annular flange 20 and comprises corresponding mating steps which press against the undersurface of the annular flange. At its lower end the retainer comprises a horizontal sealing ring 26 against which the top of the finish abuts, preferably with a liner inbetween (not shown). The retainer further comprises a downward lip 28 and an outward peripheral recess 30 facing the lip 28. The upper end of the annular retainer 24 is formed with a taper 32.

A stepped pump body 34 comprises an upper cylindrical wall 36 having an outward lip 38 which fits into the recess 30 in the retainer. At the lower end of the upper cylindrical wall 36 is an inward annular step 40 to the lower end of which is unitarily connected a lower cylindrical wall 42. At its lower end the lower cylindrical wall 42 is formed with an intake comprising a reduced socket 44 receiving the customary dip tube 46 telescoping fixedly upwardly therein. Inside the cylindrical wall 42 a central spring mount 48 is supported on three radial legs 50 integrally molded with the wall 42 and which permit passage of fluid through ports 51 therebetween.

A main piston 52 is reciprocably disposed inside the retainer 24 and comprises an upper tubular outlet portion 54 which is integral at its lower end with a lower tubular portion 56. At the lower end of the upper portion 54 there steps outwardly the integral piston annular flange and seal 58 which extends downwardly to engage the inside surface of the upper cylindrical wall 36. The distal edge 58*a* of the piston seal is thinned and sealingly engages against the inside of the upper cylindrical wall.

Spaced below the piston seal 58 the lower tubular portion 56 of the main piston is formed with elongate windows 60. Preferably the windows are spaced uniformly about the wall of the lower tubular portion 56. The lower end of the main piston 52 is formed with an outward sealing rib 62 which engages the inside of the lower cylindrical wall 42 in sealing engagement. A downwardly facing annular stop 63 extends inwardly of the piston 52 a short distance above the windows 60.

Thus, the main piston 52 and the body 34 are, in effect, a stepped piston telescoping inside a stepped body. Between them they define a pumping chamber 64. An inlet chamber 66 (FIG. 1) is defined by the lower cylindrical wall 42 and the lower tubular portion 56.

The actuator 14 comprises a top wall 68 and a cylindrical side wall 70. The side wall 70, as shown, is formed with an annular hook 72 at its lower end which, in assembly, is pressed into the inward lip 74 about the upper end of the cylindrical shell 18 of the closure 12 to retain the actuator.

The dispensing spout 16 is an integral molded tube extending radially of the top wall 68 and merging with a downward unitary tubular axial riser 76. The top wall is formed with an abbreviated downward annular ring 77 which meets taper 32 on the retainer. As shown in FIG. 1, the interior of the tubular riser 76 is formed with three evenly spaced inward ribs 78 with spaces 79 inbetween.

The lower end of the tubular riser 76 is formed (FIG. 1) with a downward taper 80 which preferably corresponds to the angle of the upward taper 55 of the adjacent inside surface of the main piston.

The stem 94 is the valving element of the assembly. It comprises an elongate upper end 86 which is received within the axial interior of the riser 76 and engages fixedly the ribs 78 and is secured against any movement with respect thereto by means of pronounced detents 88. Intermediate its ends the stem 84 is enlarged outwardly to provide an annular sloping shoulder 90 which butts against a complementing shoulder on the ribs 78 at the lower end of the tubular axial riser, thus assuring that the stem will not collapse into the riser 76 when the actuator is depressed.

Spaced downward from the shoulder 90 and above the lower end 94 of the stem is an outward head 95 having an annular bi-directional fin-type seal 96. This seal is connected by a thin peripheral web 97 to the rest of the stem 84. A spiral spring 98 has its upper end receiving the lower end 94 of the stem and its lower end receiving the central spring mount 48. It is a compression spring in the present environment and serves to urge the stem 84 upward at all times.

Figure 2:
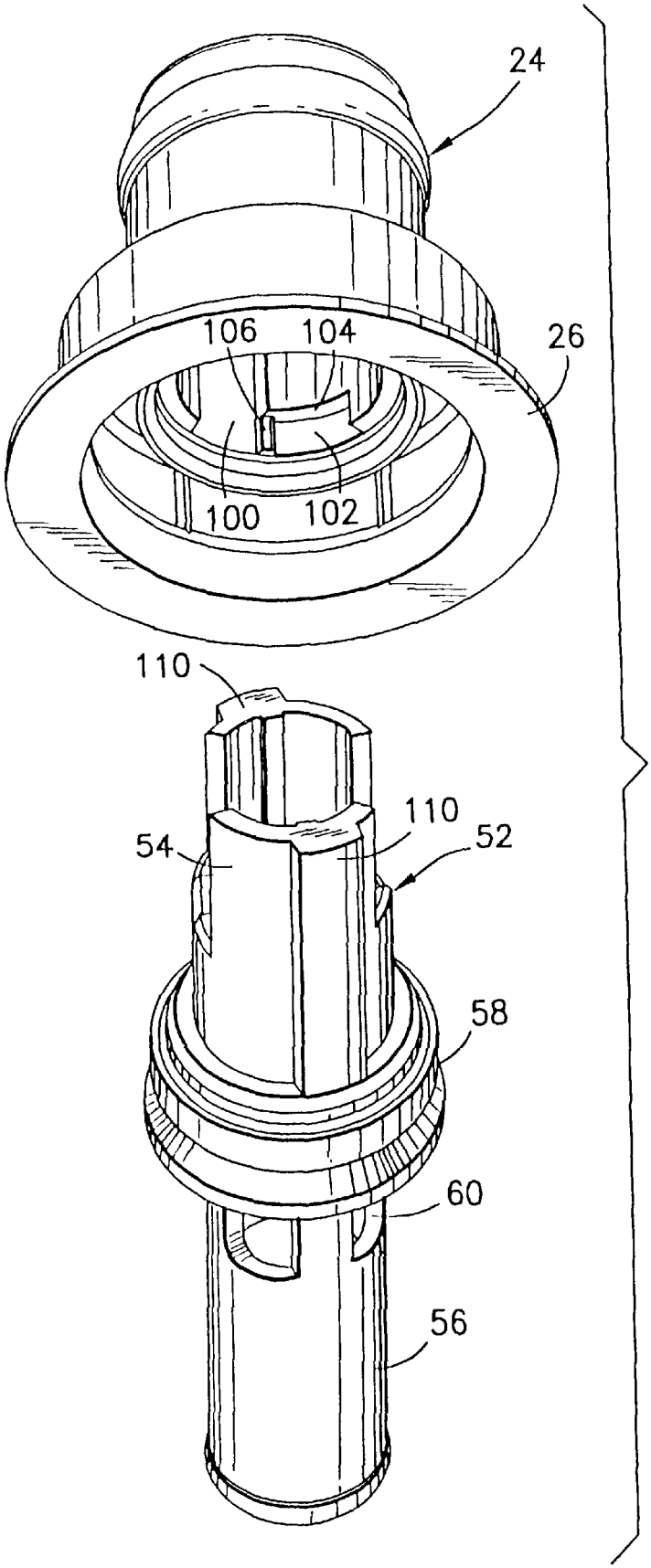
FIG. 2 is an enlarged exploded perspective view of the retainer and piston of the pump to show the interfitting of the lockdown parts and the detent therefor.

FIG. 2 shows in perspective exploded view the interfitting elements of the retainer 24 and the piston 52. As shown, the inside of the retainer 24 is formed with an inward longitudinal channel 100. At the lower end of the channel there is disposed in a clockwise direction when viewed from above, an adjoined recess 102 bounded upwardly by a downwardly facing lockdown shoulder 104. Intermediate the recess 102 and the channel 100 is an inward detent 106. These elements are duplicated in a diametrically opposite position in the retainer.

The piston 52 is formed on its upper tubular outlet portion 54 with longitudinal outward projections 110.

In assembly, the upper tubular outlet portion 54 slides within the opening of the retainer 24, the longitudinal projections 110 sliding in the channels 100 of the retainer. In the lockdown mode the actuator is pressed fully downward causing the projections 110 on the piston to move down in channel 100 until their upper ends are at the level of the recesses 102. The actuator is then turned clockwise and the projections 110 bump over the detents 106 (the projections 110 and detents 106 comprise a detent system) into the recesses 102 whereat the upper ends of the projection engage the downward shoulders 104 in lockdown position. The projections 110 and shoulders 104 are thus the "lockdown means" for the actuator and piston.

In unlocking mode the actuator is turned counterclockwise causing the projections 110 to bump over the relatively stiff detent 106 to align with channel 100, permitting the piston to pop up.

Figure 3:
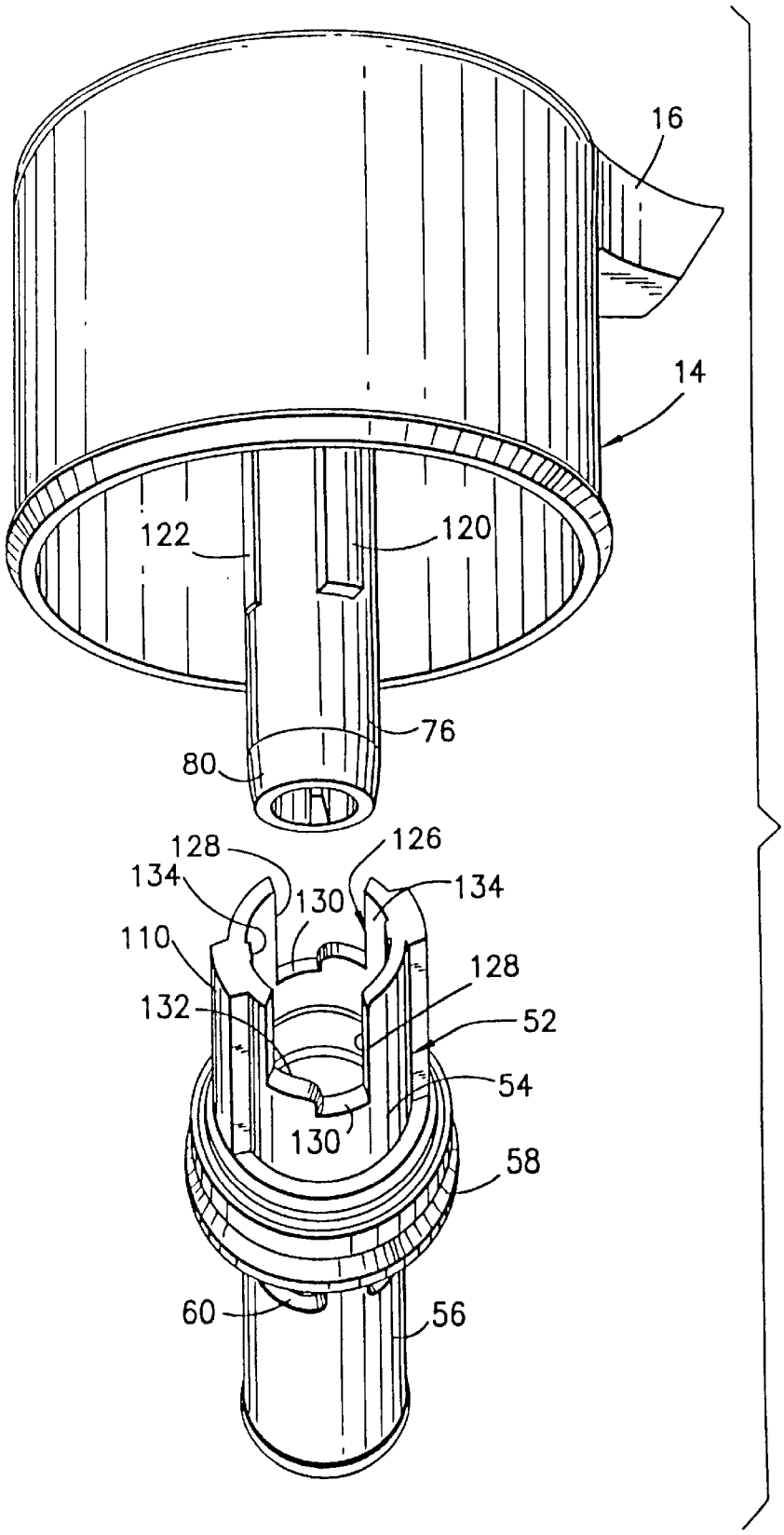
FIG. 3 is an enlarged exploded perspective view of the actuator and piston of the pump to show the interfitting of the discharge valve lock and the detent therefor.

FIG. 3 is an enlarged perspective exploded view showing the interfitting parts of the actuator 14 and the piston 52. The actuator comprises the integral riser 76 having on its outer surface a longitudinal rib 120. Actually, there may be two outward ribs 120 diametrically situated. Intermediate the ribs 102 is a shallower or less high detent rib 122, also longitudinal of the riser 76. A second detent rib 122 (not shown) may be situated on the opposite side of the riser 76.

The upper tubular outlet portion 54 of the piston 52 is formed with a lost-motion downward slot 126. This is defined by opposite side walls 128 and an upward abutment surface 130. A pump-disabling upward abutment surface 132 is adjacent to the first upward abutment surface 130 and stepped upward clockwise therefrom when viewed from above. As shown, the slot 126 is replicated in the upper tubular outlet portion 54 at a diametrically opposite position. The pump-disabling upward abutment surface 132 may also be termed the discharge valve locking surface. The ribs 120 and the surface 32 are thus the "locking means" for the outlet valve 60, 96.

The inner surface of the upward tubular outlet portion 54 is formed inbetween the slots 126 with shallow inward detent ribs 134 longitudinal diametrically opposed.

In assembly, the riser 76 is received into the opening of the piston 52, the abutment ribs 120 fitting into the slots 126 in alignment with the first upward abutment surfaces 130. In the locking of the discharge valve, the actuator is turned clockwise so that the bottom of ribs 120 engage the pump-disabling abutment surfaces 132 eliminating lost-motion. In doing so, the detent ribs 122, 134 mutually engage to provide a relatively less stiff detent system for the discharge valve lock.

Thus, the engagement of the projections 110 with the detent 106 may be regarded as the relatively more stiff detent means on the piston, and retainer and the engagement of the ribs 122 and 134 may be regarded as the relatively less stiff detent system on the actuator and piston. It is understood that the torque necessary to turn the actuator 14 will depend not only on the respective stiffness of the detents, but also the radius of the detents away from the axis of the actuator. However, what is the concern here is which of the detents yields first during the unlocking. The overall effect is that invariably, as the actuator is turned, the discharge valve lock will be the first detent to "give", and the lockdown detent will be the second so that when the actuator pops up, the discharge valve lock is invariably cleared. Hence, the terms "relatively less stiff" and "relatively more stiff" herein include not only the "yieldability" but also the difference in force of the torque at the radius at which the detent is situated.

The operation of the pump will now be explained. When it is desired to dispense lotion or other liquid from the container (not shown), the actuator 14, normally in the first position axially with respect to the piston shown in FIG. 1, is depressed. In this process the rigidly joined-together actuator 14 and stem 84 together as a unit are manually pressed downward. Prior to any downward movement of the main piston 52, there is a sliding movement of the actuator riser 76 down into the main piston 52 until the rib 120 approaches and engages the upward abutment surface 130 inside the main piston. In doing so, the lost-motion space between the actuator and the piston, as indicated in FIG. 1, is eliminated for the remainder of the downstroke. This closing of lost-motion space has the effect of moving the bi-directional fin-type seal 96 downward along the windows 60 of the piston to a second position to open up a discharge aperture above the seal.

Continued downward movement of the main piston 52 as the actuator is pushed down farther, pressurizes lotion in the pumping chamber 64, causing it to escape upward through the discharge aperture into the space surrounding the stem and then up through spaces 79 between inward ribs 78 and out the spout 16 to define a discharge path.

The lower limit end of travel of the main piston 52 is determined when the lower end 94 of the stem 84 engages the central spring mount 48 and the ring 77 on the actuator 14 engages taper 32.

When or before the piston bottoms out, as described above, the user will release the actuator, permitting the spring 98 to move the actuator spout/stem 84 upward. This raising of the stem 84 causes the bi-directional fin-type seal 96 to move upward with respect to the piston and the elongate windows 60, closing the discharge aperture. Simultaneously, a lower aperture (FIG. 1) is opened as the seal 96 exposes it. The seal 96 engages stop 63. Continued upward movement of the stem reopens the lost-motion spacing of rib 120 above surface 130. With the seal 96 driving upward against stop 63, movement continues as the piston 52 rises and expands the pumping chamber 64. Vacuum created thereby draws fluid up the dip tube 46 into inlet chamber 66 and finally through the aperture 102 to define an inlet path and into the pumping chamber 64.

When the main piston flange and seal 58 move up and engage the lower end of the downward lip 28 (FIG. 1), the upward limit of travel is reached. In this first position, with the chamber 64 filled with lotion, the pump is ready for the next depression stroke. If the chamber 64 is empty at the beginning of the process, two or three strokes of the actuator may be necessary to fill it. This is a common characteristic of simple pumps of this type.

In the downward and upward movement of seal 96 with respect to the windows 60, the seal may be regarded as a shuttle valve.

The operation of the lock will have already been inferred by those skilled in the art. With the actuator and seal 96 in first position, the actuator will be turned clockwise. One will feel a bump (detent means 122, 134) signifying that the discharge valve is locked closed. One may then depress the actuator all the way down and turn the actuator farther in a clockwise direction. One will feel a second bump (detent means 110, 106) signifying that the pump is in lockdown position.

On preparing the dispenser for use, the consumer will turn the actuator counter-clockwise. She will first feel the bump as the discharge valve locking detents (122, 134) clear and then the stiffer lockdown detents (110, 106) will clear and the actuator will pop up. At this point the consumer will be assured that the pump is totally operative. (Had the lock-down detent cleared first, the actuator would pop up but the discharge valve would still be locked and the consumer would think she had a defective unit.)

The benefit of the present pump is, of course, that there is presented an effective tactilly perceivable lock against drool or discharge and an effective tactilly perceivable lockdown for shipping. The special beauty of the present arrangement is that the pump may be unlocked and ready for use from lockdown with one simple turn of the actuator (illustratively a 90° turn, that is; a quarter turn).

Variations in the invention are possible. Thus, while the invention has been shown in one limited embodiment, it is not so limited but is of a scope defined by the following claim language which may be broadened by an extension of the right to exclude others from making, using or selling the invention as is appropriate under the doctrine of equivalents.

What is claimed is:

1. A pump dispenser comprising:

a. a tubular piston and a hollow body receiving the piston, the tubular piston and hollow body defining a pumping chamber, b. an annular retainer secured to the body and supporting the piston for reciprocation, c. an outlet valve for the pumping chamber, d. locking means for locking the outlet valve closed, e. an axially disposed reciprocal actuator means for the piston, the actuator means having lockdown means, the actuator means controlling the outlet valve by vertical movement and controlling the locking means for the outlet valve and the lockdown means by rotary movement so that the dispenser is operable only if the actuator means is turned in one rotary unlocking direction to unlock the outlet valve and to undo the lockdown means, f. a first detent system comprising a first longitudinal rib disposed between the actuator means and piston for the locking means for the outlet valve, g. a second detent system comprising a second longitudinal rib disposed between the piston and retainer for the lockdown means, the second detent system being more difficult to overcome than the first detent system as the actuator means is rotated in the unlocking direction so that the outlet valve is freed before the lockdown means.

2. A pump dispenser as claimed in claim 1 wherein the lockdown means includes an outward projection on the piston and a channel on the retainer in which the projection rides, and a lateral recess at the lower end of the channel and the second detent system comprises the outward projection and the second longitudinal rib which is disposed between the channel and the recess.

3. A pump dispenser as claimed in claim 1 wherein the actuator means has a tubular stem and the outlet valve is a recriprocable seal inside the piston attached to the actuator means and operating over an outlet opening inward in the tubular piston and a lost-motion connection connects the actuator means and piston and the locking means for the outlet valve eliminates the lost-motion connection to hold the seal over the outlet opening and the first detent locking system comprises the first longitudinal rib disposed on the actuator means stem and a third longitudinal rib on the inside of the tubular piston.

* * * * *